US012565812B2

(12) United States Patent
Funderud et al.

(10) Patent No.: US 12,565,812 B2
(45) Date of Patent: Mar. 3, 2026

(54) ROTATING CHECK VALVE FOR IMPROVED DOWNHOLE OPERATIONS

(71) Applicant: Schlumberger Technology Corporation, Sugar Land, TX (US)

(72) Inventors: Are Funderud, Vanvikan (NO); Idalia Ovalle Stevenson, Sugar Land, TX (US); Rishi Mishra, Rosenberg, TX (US); Dan Tabalan, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/431,167

(22) Filed: Feb. 2, 2024

(65) Prior Publication Data

US 2025/0250867 A1 Aug. 7, 2025

(51) Int. Cl.

| | |
|---|---|
| ***E21B 10/44*** | (2006.01) |
| ***E21B 4/02*** | (2006.01) |
| ***E21B 10/18*** | (2006.01) |
| ***E21B 10/46*** | (2006.01) |
| ***E21B 10/62*** | (2006.01) |
| ***E21B 21/10*** | (2006.01) |

(52) U.S. Cl.

CPC ..... *E21B 10/44* (2013.01); *E21B 4/02* (2013.01); *E21B 10/18* (2013.01); *E21B 21/10* (2013.01); *E21B 10/46* (2013.01); *E21B 10/62* (2013.01)

(58) Field of Classification Search

CPC ..... E21B 10/44; E21B 10/18; E21B 10/46; E21B 10/62; E21B 4/02; E21B 21/10

See application file for complete search history.

(56) References Cited

U.S. PATENT DOCUMENTS

| | | | | |
|---|---|---|---|---|
| 2010/0018775 | A1* | 1/2010 | Hallundbaek | E21B 27/005 175/94 |
| 2015/0322728 | A1 | 11/2015 | Cox | |
| 2016/0040495 | A1* | 2/2016 | Mahajan | E21B 10/60 166/99 |
| 2020/0300049 | A1* | 9/2020 | Edvardsen | E21B 27/04 |
| 2022/0220827 | A1* | 7/2022 | Haugland | B01D 29/6407 |
| 2024/0418050 | A1 | 12/2024 | Sheiretov | |

FOREIGN PATENT DOCUMENTS

| | | | | |
|---|---|---|---|---|
| CA | 3057345 | A1 * | 4/2020 | E21B 10/00 |
| CN | 212958473 | U | 4/2021 | |
| EP | 3387212 | A1 | 10/2018 | |
| NO | 345518 | B1 * | 3/2021 | B08B 9/0436 |
| WO | WO-2023183577 | A1 * | 9/2023 | E21B 27/00 |

* cited by examiner

*Primary Examiner* — Caroline N Butcher
(74) *Attorney, Agent, or Firm* — Jeffrey D. Frantz

(57) ABSTRACT

A milling bit is disclosed for debris collection within a wellbore. A check valve can be part of a debris removal tool that includes a motor, a pump, a gearbox, a bailer, the milling bit, and rotational shafts. In an example, on its uphole end, the milling bit can be coupled with the check valve. On its downhole end, the milling bit can be configured for debris removal with cutting edges. The downhole end can also include openings that provide access to an internal cavity of the milling bit. The internal cavity can extend the entire length of the milling bit. This allows the pump to pull drilling fluid into the bailers through the milling bit and check valve. As a result, the debris removal tool can simultaneously remove obstructions in a wellbore and collect debris from the obstruction removal.

19 Claims, 6 Drawing Sheets

ROTATING CHECK VALVE FOR IMPROVED DOWNHOLE OPERATIONS

BACKGROUND

Field

The present disclosure generally relates to a downhole tool, and more particularly to methods and apparatus for loosening and collecting wellbore debris.

Description of the Related Art

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. Often debris needs to be removed from the wellbore after it is drilled. Wellbore debris can include sand, scale, metallic junk, proppant, and other solids that may be mixed with pipe dope or asphaltenes. One of the challenges in designing a tool for removing debris is to provide a means to retain collected debris inside the collection chambers while the tool is being retrieved from the well.

SUMMARY

Systems, methods, and an apparatus are disclosed herein for an improved milling bit for downhole operations within a wellbore. The function of the milling bit is to allow the flow of fluid in one direction (downhole to uphole) while simultaneously milling debris in a wellbore. The milling bit can be part of a downhole drilling assembly that can simultaneously mill and filter debris in a wellbore. Such a downhole assembly can include various components, such as a motor, a pump, a gearbox, a bailer with filters, a check valve, and the milling bit. The gearbox can modify the rotational speed and torque generated by the motor so that the motor can drive the pump and milling bit at different speeds and torques. The pump can pump drilling fluid into the wellbore while the milling bit breaks up debris in the wellbore. The pump can create a suction force that pulls the drilling fluid and debris into the downhole assembly through the milling bit and the check valve. The filters in the bailer can capture the debris, and clean fluid can return to the pump where it is again pumped into the wellbore.

An embodiment of the milling bit can include an adapter that rotationally couples the milling bit with the check valve. A rotating shaft can be rotationally coupled to the check valve, thereby allowing the check valve and milling bit to rotate with the rotating shaft. The milling bit can include blades with cutting edges at the head of the milling bit. The milling bit can include slots between blades that allow drilling fluid and milled debris to pass through into an inner cavity of the milling bit. The inner cavity can extend the entire axial length of the body of the milling bit so that fluid and drilling debris can enter the milling bit through the openings and pass through the body into the check valve.

The milling bit can include channels/gullets on the outer surface of the milling bit's body. The channels can alternate with gauge pads that facilitate side cutting using cutting inserts, such as diamond insert. The gauge pads and gullets can be helically shaped to facilitate fluid flow downhole during drilling operations. This helps force drilling fluid and debris into the milling bit through the openings. The pump can also create a suction force that pulls the drilling fluid and debris into the downhole assembly through the milling bit. The drilling fluid and debris can pass through the milling bit and check valve, and then enter into bailers that include filters. The filters can capture the debris, and clean drilling fluid can be pulled back into the pump and then pumped back into the wellbore.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
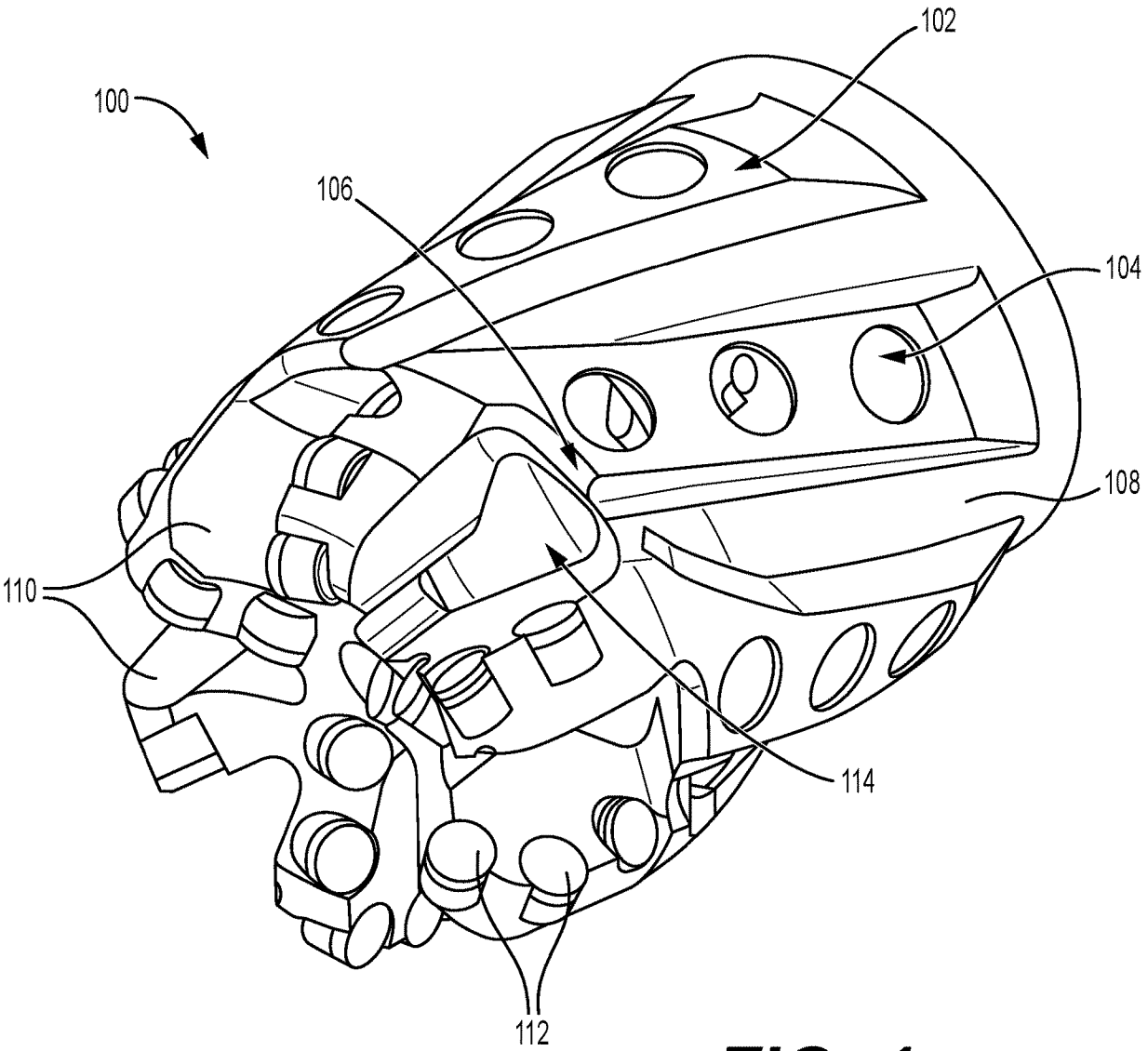
FIG. 1 is an illustration of a perspective view of a milling bit according to an embodiment of the invention.

FIG. 1 is an illustration of a perspective view of a milling bit 100 according to an embodiment of the invention. The milling bit 100 can include blades 110 with cutting edges 112 at the head of the milling bit 100. The cutting edges 112 can be used for breaking apart obstructions in a wellbore. The cutting edges 112 can be made of any suitable material for drilling a wellbore, and the type of material used can depend on various factors, such as the material being cut, cutting speeds, tool life requirements, and overall demands of the machining process. As some examples, the cutting edges 112 can be high-speed steel ("HSS"), carbide, a cobalt alloy, ceramic, or diamond-coated.

The milling bit 100 can include openings 114 between the blades 110 and the neck of the milling bit 100. The openings 114 can lead to an interior cavity in the body of the milling bit 100 through which drilling fluid can pass through into a check valve and bailers. The milling bit 100 can be part of a debris removal tool that includes a pump, bailers with filters, and a check valve. During operation, the pump can force drilling fluid into the wellbore outside of the debris removal tool and toward the milling bit 100. The pump can also create a suction force that draws the fluid into the debris removal tool through the openings 114 in the milling bit. The drilling fluid and debris can enter through the openings 114, pass through the interior cavity of the milling bit 100, pass through a check valve, and enter bailers with filters that capture loose debris created by the milling process. Clean drilling fluid can then continue uphole into the pump and be cycled back into the wellbore.

The milling bit 100 can include gauge cutters 106 that are used to confirm that a wellbore is a correct diameter throughout its whole length. The gauge cutters 106 can extend radially more than any other component of the debris removal tool to ensure that the wellbore is wide enough so that all other components can pass through.

The milling bit 100 can include gauge pads 102 that allow the primary cutting structure to side-cut aggressively at very low lateral bit force levels. The gauge pads 102 are designed as protruding surfaces or elements that maintain a specific distance or gauge during the milling process, effectively serving as contact points or reference surfaces. As lateral bit force increases, the side-cutting response levels off as the gauge pad 102 encounters the borehole wall. The gauge pads 102 can include cutting inserts 104 to aid in the lateral cutting. The cutting inserts 104 can be made of any material suitable for cutting, such as HSS or diamond.

The milling bit 100 can include channels 108 for directing drilling fluid in the downhole direction toward the debris. The channels 108 can be helical shaped gullets that force drilling fluid downhole while the milling bit 100 rotates. As an example, when viewed from an uphole to downhole direction, the milling bit 100 shown in FIG. 1 will force drilling fluid downhole when the milling bit 100 is rotated counterclockwise. This can help direct the drilling fluid toward the debris being milled and then through the openings 114 and into the debris removal tool.

Figure 2:
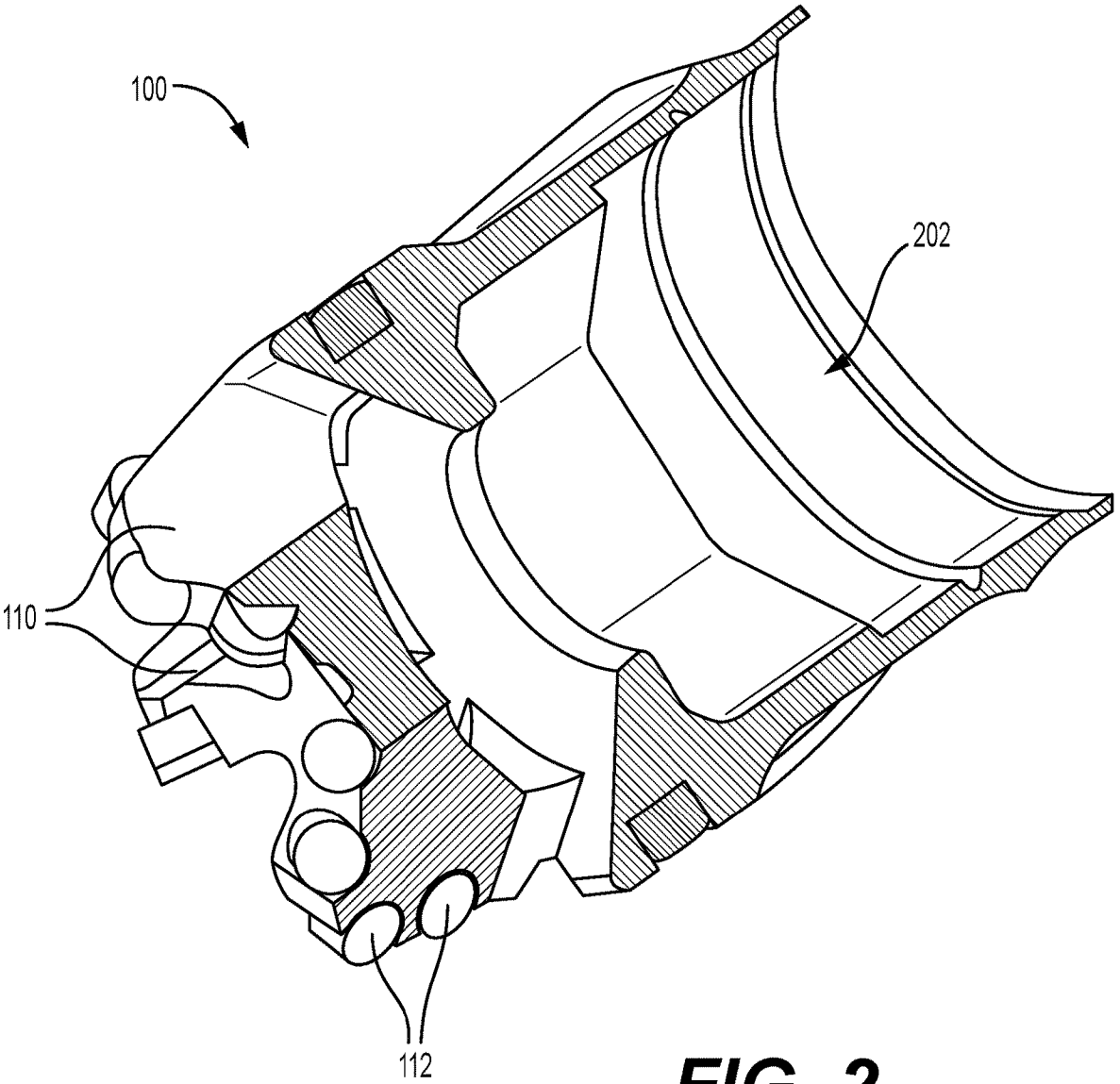
FIG. 2 is an illustration of a cross-section view of the milling bit.

FIG. 2 is an illustration of a cross-section view of the milling bit 100. The blades 110 and cutting edges 112 are shown. The internal cavity 202 discussed previously is also shown. The milling bit 100 can be coupled to a check valve that also has an internal cavity through which drilling fluid and debris can pass through. In one example, the milling bit 100 can be rotationally coupled to the check valve, and so that they rotate together. Alternatively, the milling bit 100 can be coupled with a shaft that passes through the check valve so that the milling bit 100 rotates independently from the check valve. The connection between the milling bit 100 and the check valve can be sealed to prevent drilling fluid from exiting. For example, an O-ring can be used as a seal.

Figure 3A:
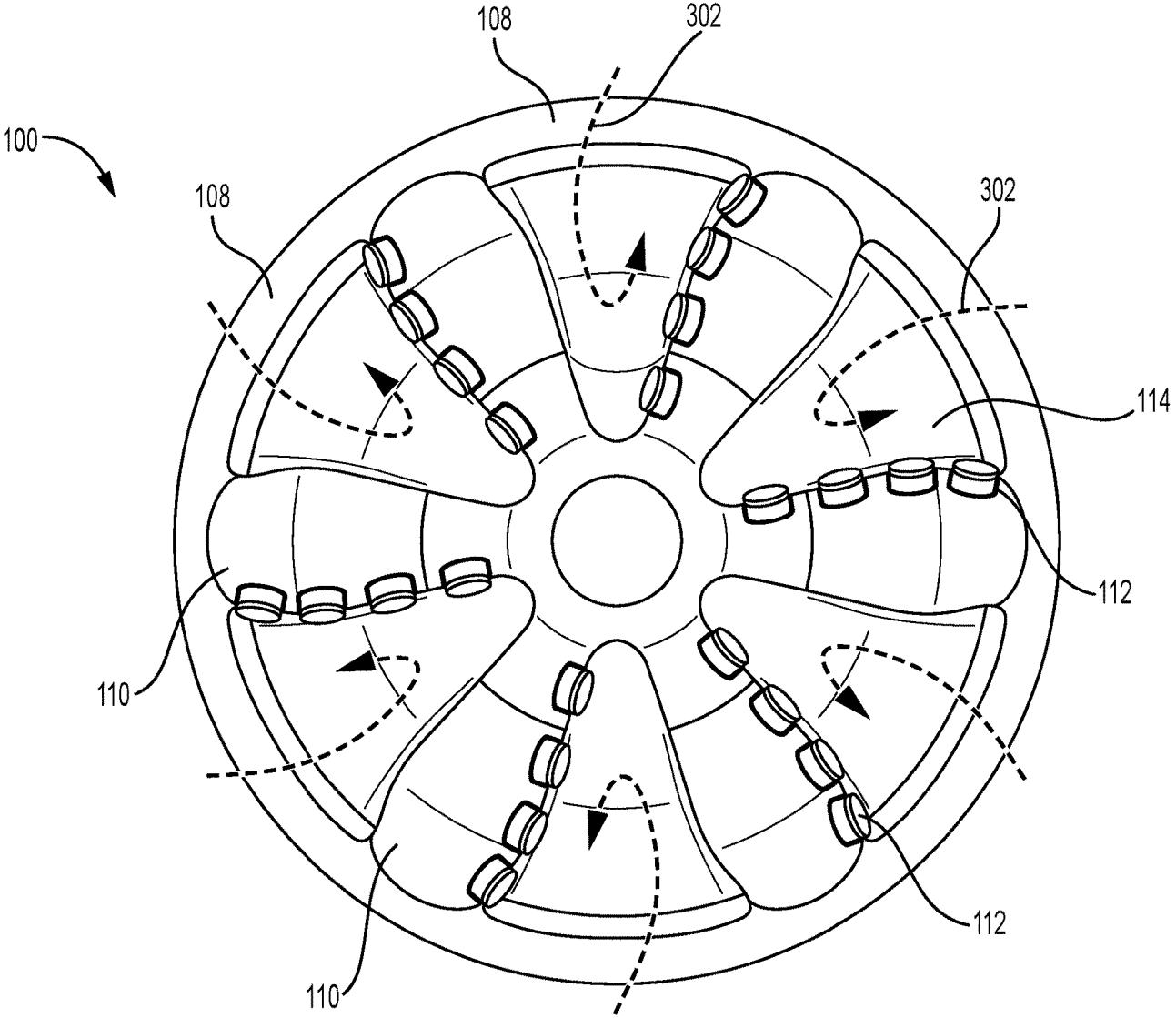
FIG. 3A is an illustration of fluid flow when the milling bit is operating.
Figure 3B:
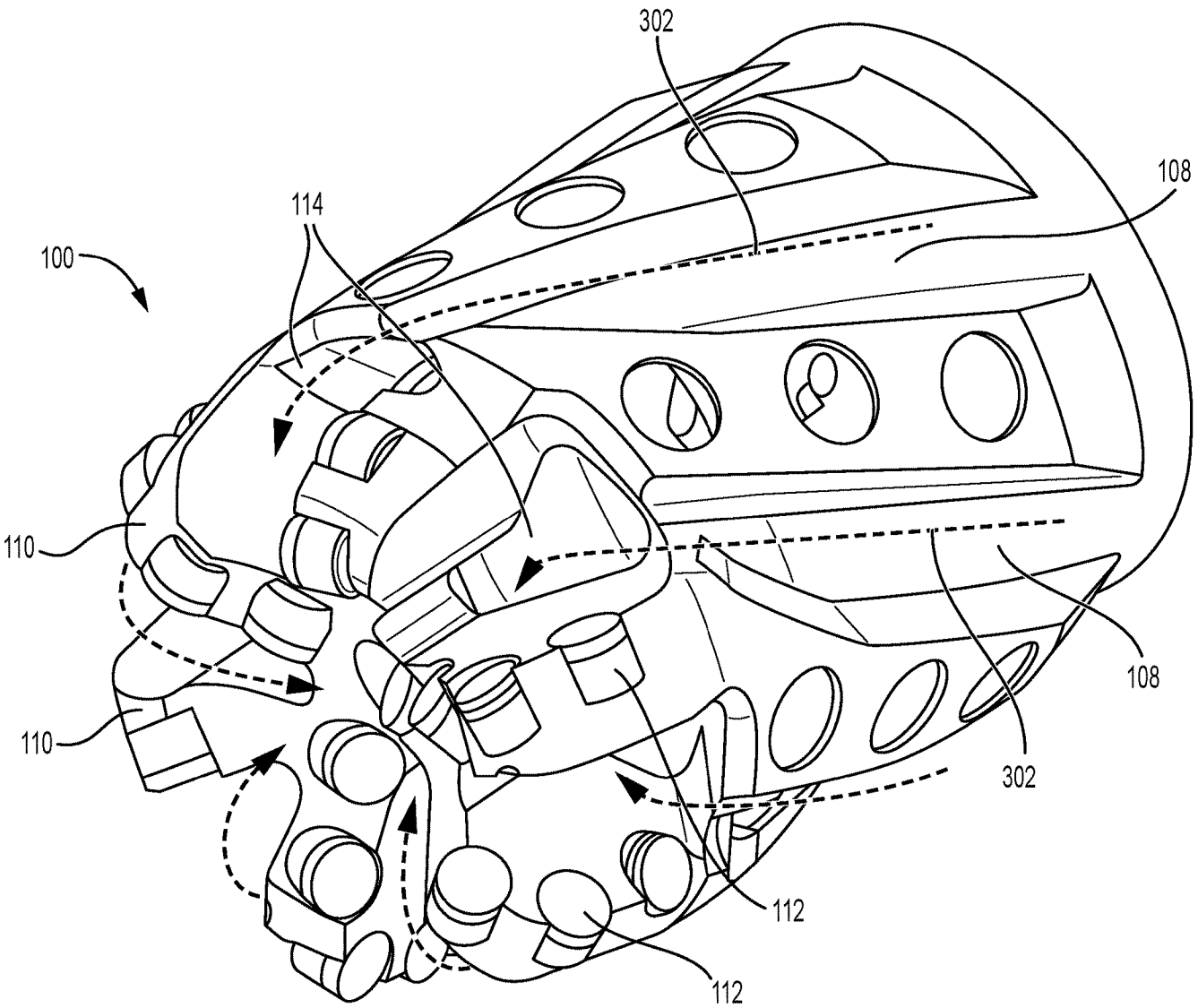
FIG. 3B is an illustration of a perspective view of fluid flow when the milling bit is operating.

FIGS. 3A and 3B illustrate fluid flow while the milling bit 100 is operating. As stated previously, the milling bit 100 can be part of a debris removal tool that includes a pump. While the debris removal tool is inserted into a wellbore, the pump can be located uphole of the milling bit 100 can pump water downhole toward the milling bit 100. While the milling bit 100 rotates, the cutting edges 112 can break apart obstructions in the wellbore. The flow of drilling fluid is illustrated by the flow arrows 302. As shown, the drilling fluid can travel through the channels 108 toward the head of the milling bit 100. The helical structure of the channels 108 can further direct the drilling fluid downhole toward the obstruction while the milling bit 100 rotates. The pump can create a suction force that pulls the drilling fluid and loose debris through the openings 114 and into the milling bit 100.

Figure 4:
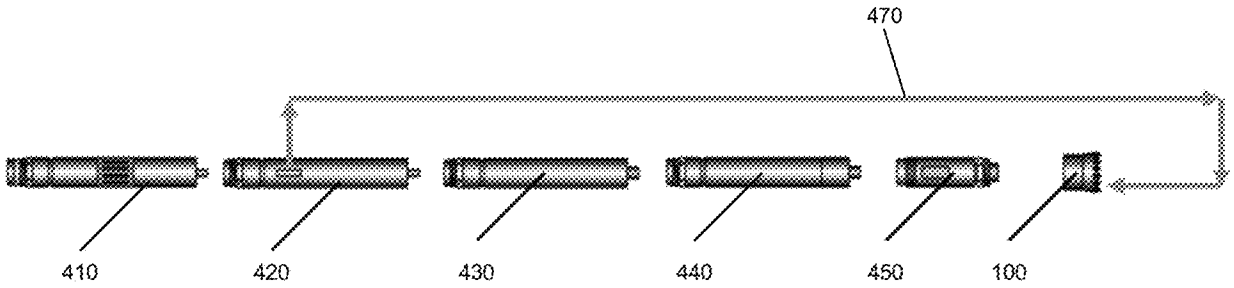
FIG. 4 depicts a schematic of downhole assembly for debris removal that includes the milling bit.

FIG. 4 shows a schematic of an example debris removal assembly 400 that includes the milling bit 100, according to an embodiment of the disclosure. The debris removal tool 400 includes an ADRM 410, a pump 420, a gear box 430, a bailer 440, a check valve 450, and the milling bit 100. When positioned inside a wellbore, the ADRM 410 is at the uphole end and the milling bit 100 is at the downhole end. The ADRM 410 includes subcomponents that drive the various components of the debris removal assembly 400. The ADRM 410 can drive the pump 420, which forces drilling fluid out of the debris removal assembly 400 and into a cavity of the wellbore. The pump can be any kind of pump suitable for drilling a wellbore. In one example, the pump 420 can be a centrifugal pump. The drilling fluid can be any fluid used in drilling operations, such as a fluid-based mud that includes fluid, clays, polymers, and additives; an oil-based mud that includes mineral oil or synthetic oil, clays, and various additives; a synthetic-based mud that includes synthetic oils and additives; a brine-based mud that includes fluid with high salt content (brine) and additives; or a polymer drilling fluid that includes fluid with added polymers.

The drilling fluid can be pulled back into the downhole assembly through the milling bit 100, as indicated by the arrows 470. The milling bit 100 can break up rock formations, which results in debris. The pump 420 can create a suction force that pulls the drilling fluid and debris into the debris removal assembly 400 through the openings 114 of the milling bit 100, and then through the check valve 450 and into the bailer 440.

The bailer 440 can include filters (not shown), that catch debris pulled into the debris removal assembly 400. Clean fluid then continues through the gear box 430 and back into the pump 420 where it is then pumped back into the wellbore area. The gearbox 430 can include gears, bearings, and other subcomponents that modify the speed and torque generated by the motor. The downhole end of the gearbox 430 can be rotationally coupled to a shaft that passes through the bailer 440 and rotationally coupled with the uphole end of the check valve 450. This allows the motor to simultaneously drive the pump 420 and milling bit 100 at different speeds and torques. This in turn allows the downhole assembly to drill obstructions in the wellbore while simultaneously pulling in and filtering debris created by the drilling.

Figure 5:
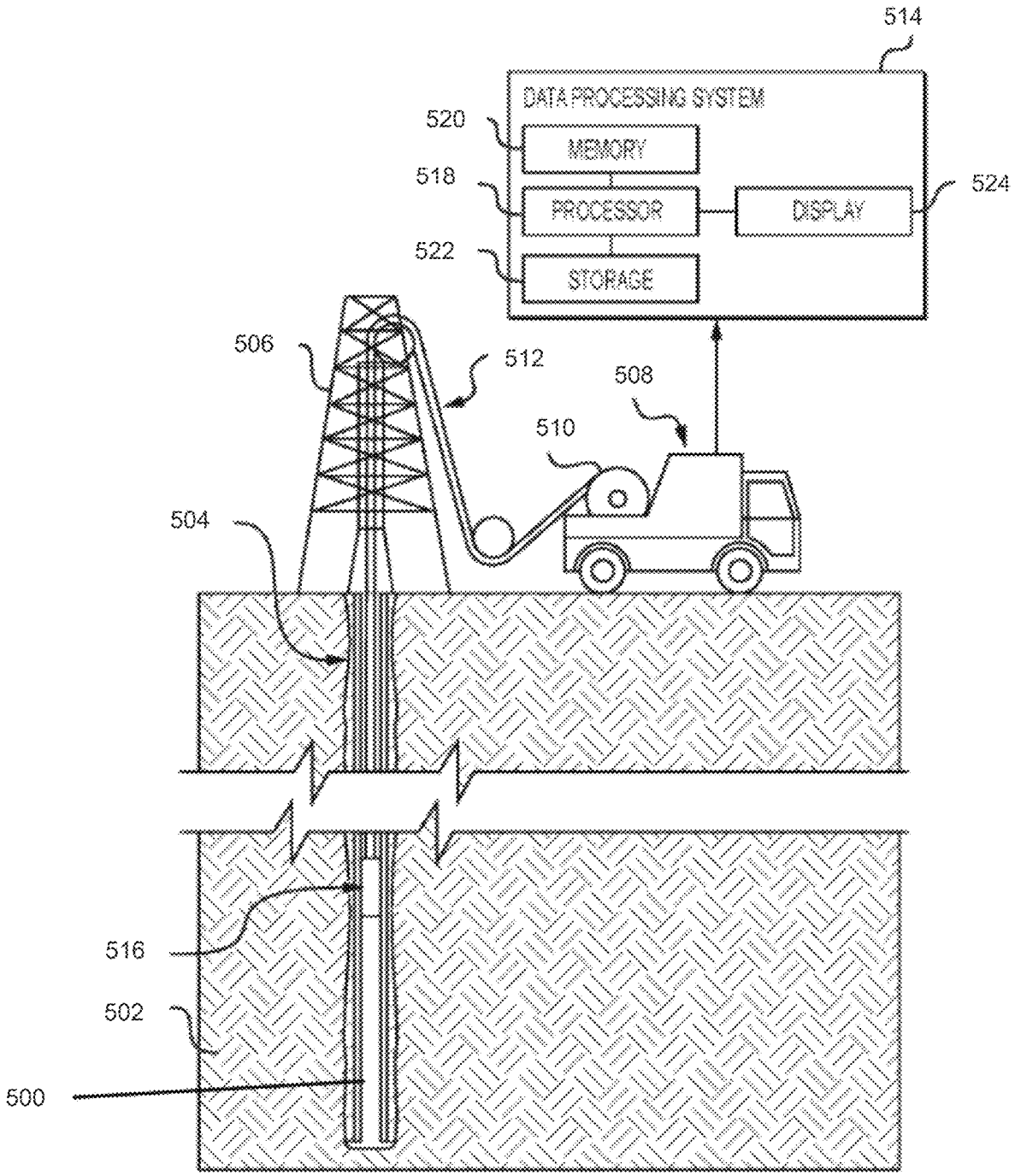
FIG. 5 depicts an exemplary well site where the present invention can be utilized.

FIG. 5 shows an exemplary well site where the present invention can be utilized. A formation 502 has a drilled and completed wellbore 504. A derrick 506 above ground may be used to raise and lower a debris removal assembly (e.g., the debris removal assembly 400 with the milling bit 100) into the wellbore 504 and otherwise assist with well operations.

A wireline surface system 508 at the ground level includes a wireline logging unit, a wireline depth control system 510 having a cable 512, and a control unit 514. The cable is connected to a connection assembly 516 that may be lowered downhole. The control unit 514 includes a processor 518, memory 520, storage 522, and display 524 that may be used to display and control various operations of the wireline surface system 508, send and receive data, and store data.

The connection assembly 516 includes equipment for mechanically and electronically connecting the debris removal tool with the cable 512. The cable 512 includes a support wire, such as steel, to mechanically support the weight of the debris removal tool and communication wire to pass communications between the debris removal tool and the wireline surface system 508. The debris removal tool 500, as described in more detail below, is installed below the connection assembly.

The wireline surface system 508 can deploy the cable 512, which in turn lowers the connection assembly 516 and debris removal tool deeper downhole. Conversely, the wireline surface system 508 can retract the cable 512 and raise the debris removal tool 500 and assembly, including to the surface. The cable 512 is deployed or retracted by the wireline depth control system 510, such as by unwinding or winding the cable 512 around a spool that is driven by a motor.

The wireline logging unit communicates with the control unit 514 to send and receive data and control signals. For example, the wireline logging unit can communicate data received from the debris removal tool to the control unit 514. The wireline logging unit likewise can communicate data and control signals received from the electronic control system 514 to the debris removal tool 500. In some examples, the wireline logging unit is part of the control unit 514. In other examples, the control unit 514 sends and receives data to and from the debris removal tool directly.

Although FIG. 5 shows the debris removal tool 500 being operated on a cable 512, the debris removal tool 500 can be attached to other types of conveyance systems, such as coil tubing. Any conveyance system can be used to mechanically support the debris removal tool 500 and mechanically raise or lower it within the wellbore 504. References to a "cable" are intended to be non-limiting, instead encompassing any known conveyance system.

In some embodiments, the shaft is fixed in the axial direction and results in axial motion of the housing. These embodiments may include ones where there is a separate concentric housing around the main housing which extends relative to the end of the main housing to accomplish a similar radial, axial, or helical debris stop.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A milling bit for debris collection within a wellbore, comprising:

a body having a proximal end for connection to a drilling assembly and a distal end configured for material removal, wherein the distal end comprises;

a first cutting edge mounted on a first cutting blade;

a second cutting edge mounted on a second cutting blade; and an opening disposed between the first cutting blade and the second cutting blade, the opening defined by the first cutting blade and the second cutting blade, the opening configured to provide access to an internal cavity of the body, the internal cavity extending an entire axial length of the body;

an outer surface having a plurality of gullets, each gullet of the plurality of gullets having a helical shape to facilitate fluid flow downhole while the milling bit rotates; and a gauge pad on the outer surface of the body, wherein the gauge pad defines a shape of the opening.

2. The milling bit of claim 1, further comprising a gauge cutter on the outer surface of the body between the first cutting edge and a gullet of the plurality of gullets.

3. The milling bit of claim 1, further comprising a plurality of gauge pads including the gauge pad, wherein the plurality of gauge pads and the plurality of gullets alternate along the outer surface of the body.

4. The milling bit of claim 1, wherein the helical shape is configured to facilitate downhole flow of drilling fluid while the milling bit operates.

5. The milling bit of claim 1, wherein the helical shape is configured to facilitate downward flow of drilling fluid in response to the milling bit is rotated counterclockwise.

6. The milling bit of claim 1, further comprising a coupling mechanism at the distal end for rotationally coupling the milling bit to a check valve.

7. The milling bit of claim 6, wherein the coupling mechanism rotationally couples the milling bit to a rotating shaft.

8. The milling bit of claim 1, wherein the first cutting edge and the second cutting edge are made of a material including at least one of high-speed steel HSS, carbide, a cobalt alloy, ceramic, or diamond.

9. The milling bit of claim 1, wherein a width of the gauge pad positionally overlaps with the opening and with the first cutting blade.

10. A debris collection tool, comprising:

a motor rotationally coupled to a first end of a pump by a first shaft;

a gearbox rotationally coupled to a second end of the pump by a second shaft;

a check valve rotationally coupled to the gearbox by a third shaft; and a milling bit coupled to the check valve and configured to rotate independently from the check valve.

11. The debris collection tool of claim 10, wherein the milling bit comprises:

a body having a proximal end for connection to a drilling assembly and a distal end configured for material removal, wherein the distal end comprises cutting edges and an opening that provides access to an internal cavity of the body, the internal cavity extending an entire axial length of the body;

an outer surface having a plurality of gullets, each gullet of the plurality of gullets having a helical shape to facilitate fluid flow downhole while the milling bit rotates; and a gauge pad on the outer surface of the body, the gauge pad having cutting inserts that facilitate side cutting.

12. The debris collection tool of claim 11, wherein the cutting edges comprise a first cutting edge mounted on a first blade and a second cutting edge mounted on a second blade, and the opening is positioned between the first blade and the second blade.

13. The debris collection tool of claim 11, further comprising a plurality of gauge pads including the gauge pad, wherein the plurality of gauge pads and the plurality of gullets alternate along the outer surface of the body.

14. The debris collection tool of claim 11, wherein the helical shape is configured to facilitate downhole flow of drilling fluid while the milling bit operates.

15. The debris collection tool of claim 11, wherein the helical shape is configured to facilitate downward flow of drilling fluid when the milling bit is rotated counterclockwise.

16. The debris collection tool of claim 10, wherein the gearbox is configured to modify rotational speed and torque generated by the motor so that, when activated, the motor drives the pump at a first rotational speed and a first rotational torque and drives the milling bit at a second rotational speed and a second rotational torque.

17. The debris collection tool of claim 10, wherein the pump comprises a centrifugal pump.

18. The debris collection tool of claim 10, wherein a bailer is positioned between the gearbox and the check valve, and the third shaft passes through the bailer.

19. The debris collection tool of claim 10, wherein the milling bit is rotationally coupled to the gearbox by a fourth shaft passing through the check valve.

* * * * *